United States Patent [19]

Enoguchi et al.

[11] Patent Number: 4,791,882

[45] Date of Patent: Dec. 20, 1988

[54] LOOSELY MOUNTED OUTER SLEEVE MEMBER WITH BIASING MEANS

[75] Inventors: Yuji Enoguchi, Higashiosaka; Masashi Yamamoto; Toshiya Natsuhara, both of Amagasaki, all of Japan

[73] Assignee: Minolta Camera Kabushiki Kaisha, Osaka, Japan

[21] Appl. No.: 105,245

[22] Filed: Oct. 7, 1987

[30] Foreign Application Priority Data

| | | | |
|---|---|---|---|
| Oct. 8, 1986 | [JP] | Japan | 61-240030 |
| Feb. 19, 1987 | [JP] | Japan | 62-37374 |
| Aug. 13, 1987 | [JP] | Japan | 62-203306 |

[51] Int. Cl.[4] ..... G03G 15/08

[52] U.S. Cl. ..... 118/653; 118/612; 118/257; 355/3 DD; 354/318

[58] Field of Search ..... 118/653, 612, 257; 354/318; 68/204; 355/3 DD

[56] References Cited

U.S. PATENT DOCUMENTS

| | | | |
|---|---|---|---|
| 2,761,365 | 9/1956 | Bridgewater | 118/257 X |
| 3,667,368 | 6/1972 | Cronig | 354/318 |
| 4,100,884 | 7/1978 | Mochizuki et al. | 118/653 |
| 4,149,796 | 4/1979 | Adachi et al. | 355/3 DD |
| 4,399,212 | 8/1983 | Boie et al. | 354/318 X |

FOREIGN PATENT DOCUMENTS

| | | | |
|---|---|---|---|
| 55-77764 | 11/1980 | Japan . | |
| 58-86578 | 5/1983 | Japan . | |
| 58-95370 | 6/1983 | Japan | 355/3 DD |
| 61-176959 | 8/1986 | Japan . | |

*Primary Examiner*—Shrive Beck
*Assistant Examiner*—Alain Bashore
*Attorney, Agent, or Firm*—Burns, Doane, Swecker & Mathis

[57] ABSTRACT

A developing device adjoins a rotatably arranged electrostatic latent image support member, and is internally provided with a rotatably disposed developing roller confronting the electrostatic latent image support member, a cylindrically formed flexible filmy or outer sleeve member having a peripheral length longer than that of the developing roller and loosely mounted around it, a couple of first members for biasing the filmy member against the developing roller to form a slack of the filmy member at a location confronting the electrostatic latent image support member, and a second member for forming a toner layer on entire external surface of the filmy member.

12 Claims, 6 Drawing Sheets

LOOSELY MOUNTED OUTER SLEEVE MEMBER WITH BIASING MEANS

BACKGROUND OF THE INVENTION

1. Field of the Invention

The present invention generally relates to a developing device for use in an electrophotographic copying machine, a printer or the like and more particularly, to a developing device which is capable of steadily providing a uniformly formed thin layer of charged toner with respect to an electrostatic latent image formed on the surface of a photosensitive member or photoreceptor of the copying machine or the like.

2. Description of the Prior Art

In an electrophotographic or electrostatic copying machine, the surface of a photoreceptor which is of an image support member is preliminarily electrically charged uniformly and is, then, exposed to light on the basis of a pattern corresponding to an image of an original document so that a latent image may be formed thereon. Subsequently, upon supply of the charged toner onto the surface of the photoreceptor having thereon the latent image formed by a developing device, the latent image is developed into a visible toner image and thereafter, the toner image obtained is transferred onto and fixed on a transfer sheet or copy paper sheet.

In the developing device for use in such electrophotographic copying machine or the like, particularly, in the developing device employing therein non-magnetic toner as one-component developer, it is especially important to supply a uniformly formed thin layer of the charged toner onto the surface of the photoreceptor.

Conventionally, U.S. Pat. No. 4,100,884 discloses one of such developing devices, in which upon supply of the non-magnetic toner onto the surface of an elastic developing roller, a blade is pressed against the developing roller so that a thin layer of charged toner may be formed on the peripheral surface thereof and a toner image is, then, formed by bringing the thin layer of the charged toner into direct contact with the surface of the photoreceptor.

In this kind of the developing device, it is necessary to contact the developing roller with the photoreceptor uniformly in a direction along its central axis. However, since it is not uncommon that the developing roller or the photoreceptor itself warps slightly, it is extremely difficult to bring both members into contact with each other uniformly in a direction of their central axes.

Furthermore, to form the thin layer of the charged toner, it is also necessary to keep the blade in contact with the surface of the developing roller under a certain pressure greater than a predetermined one. To this end, the developing roller is requested to be relatively high in hardness. On the contrary, it is desirable for the developing roller to be as soft as possible to prevent the photoreceptor from being damaged or the image from being broken on a contact portion between the developing roller and the photoreceptor. Under these circumstances, since there exist the aforegoing requests completely contrary to each other in connection with the surface hardness of the developing roller, it is actually impossible to obtain a developing roller which may satisfy both of these requests.

Meanwhile, Japanese Patent Laid-open Application No. 55-77764 discloses another developing device in which an electrically conductive thin film is arranged on the surface of a developing roller of an electrically conductive soft elastic foamed member. In this developing device, the toner is caused to electrically adhere to the surface of the developing roller with the use of a magnetic brush and the developing is, then, executed by causing the toner to adhere to an electrostatic latent image through contact between the developing roller and the surface of the photoreceptor.

However, even when the developing roller employing therein the foamed material is used, the pressure between the developing roller and the photoreceptor can not be sufficiently lowered. In particular, in the case where a peripheral speed of the developing roller is to be differentiated from that of the photoreceptor, the image formed on the photoreceptor tends to be disadvantageously spoiled.

SUMMARY OF THE INVENTION

Accordingly, the present invention has been developed with a view to substantially eliminating the above described disadvantages inherent in the prior art developing device, and has for its essential object to provide an improved developing device, in a toner supply portion of which a developing roller and a blade is kept in contact with each other under a sufficient pressure so that the toner may be charged uniformly and a thin layer thereof may be formed also uniformly.

Another important object of the present invention is to provide a developing device of the above described type which is capable of supplying the toner onto a latent image formed on a photoreceptor of an electrostatic latent image support member by steadily holding the toner in soft contact with the photoreceptor at a location thereof confronting the photoreceptor.

In accomplishing these and other objects, according to one preferred embodiment of the present invention, there is provided a developing device disposed adjacently to a rotatably arranged electrostatic latent image support member, and including a rotatably disposed developing roller confronting the electrostatic latent image support member, a cylindrically formed flexible filmy or outer sleeve member having a peripheral length longer than that of the developing roller and loosely mounted therearound, first means for biasing the filmy member against the developing roller to form a slack of the filmy member at a location confronting the electrostatic latent image support member, and second means for forming a toner layer on entire external surface of the filmy member.

BRIEF DESCRIPTION OF THE DRAWINGS

These and other objects and features of the present invention will become more apparent from the following description taken in conjunction with the preferred embodiments thereof with reference to the accompanying drawings, throughout which like parts are designated by like reference numerals, and wherein.

DESCRIPTION OF THE PREFERRED EMBODIMENTS

Figure 1:
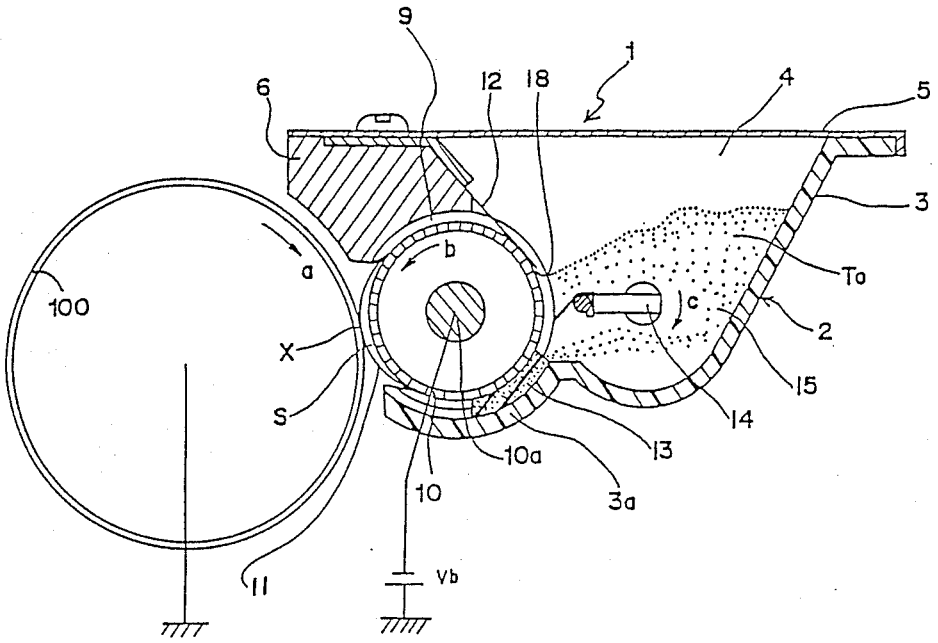
FIG. 1 is a cross-sectional view of a developing device according to a first embodiment of the present invention.

Referring now to the drawings, there is shown in FIG. 1, a developing device 1 according to a first embodiment of the present invention, which adjoins a photoreceptor drum 100 driven rotatably in a direction as shown by an arrow (a).

The developing device 1 is generally provided with a rotatably arranged developing roller 10, a filmy or outer sleeve member 11 loosely mounted around the developing roller 10, a couple of elastic guide pads 9 for biasing the film member 11 against the developing roller 10, a blade 12 pressed against the external surface of the filmy member 11 and a developer tank 2 accommodating these members 9, 10, 11 and 12 and storing therein a certain amount of toner To.

The developer tank 2 is substantially composed of a casing 3 disposed at the bottom and rear portions thereof, a couple of side plates 4, a cover 5 and a support member 6 rigidly secured to the forward portion of the cover 5.

The developing roller 10 is formed cylindrically and of an electrically conductive material such as aluminium, stainless steel or the like, with a developing bias voltage Vb being applied thereto. Alternatively, the cylindrically formed developing roller 10 may be of a metallic roller provided, at its external peripheral portion, with an electrically conductive elastic member of rubber (nitrile rubber, silicone rubber, styrene rubber, butadiene rubber or the like), plastic or the like.

Figure 3:
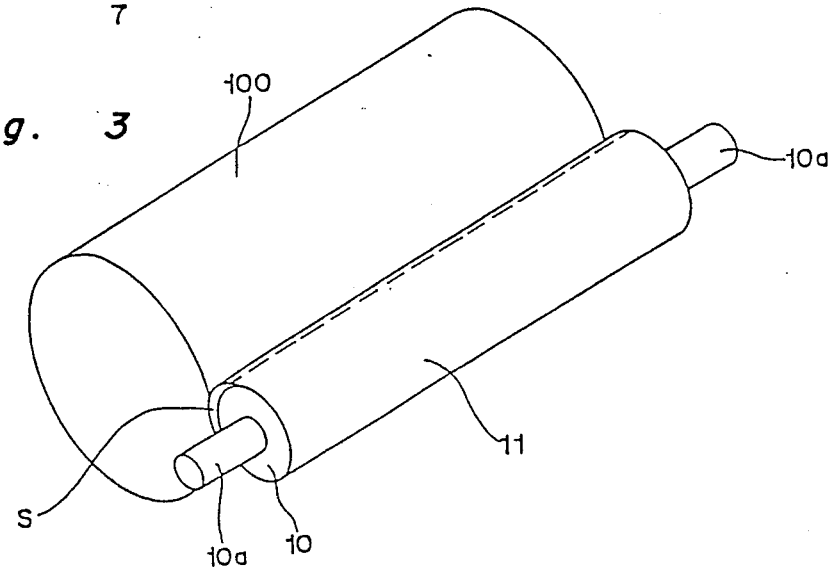
FIG. 3 is a perspective view of the developing roller loosely mounting thereon a filmy member.

The filmy member 11 is formed also cylindrically and has a peripheral length slightly longer than that of the developing roller 10 so as to be loosely mounted therearound, as shown in FIG. 3. As the filmy member 11, which has flexibility, is used either of a soft resinous sheet, for example, of polycarbonate, nylon, fluorine resin or the like, a sheet of such resin including carbon or metallic fine particles or the like, a metallic thin film of nickel, stainless steel, aluminum or the like, or a laminated sheet of the aforementioned resinous sheet and metallic thin film.

Figure 2:
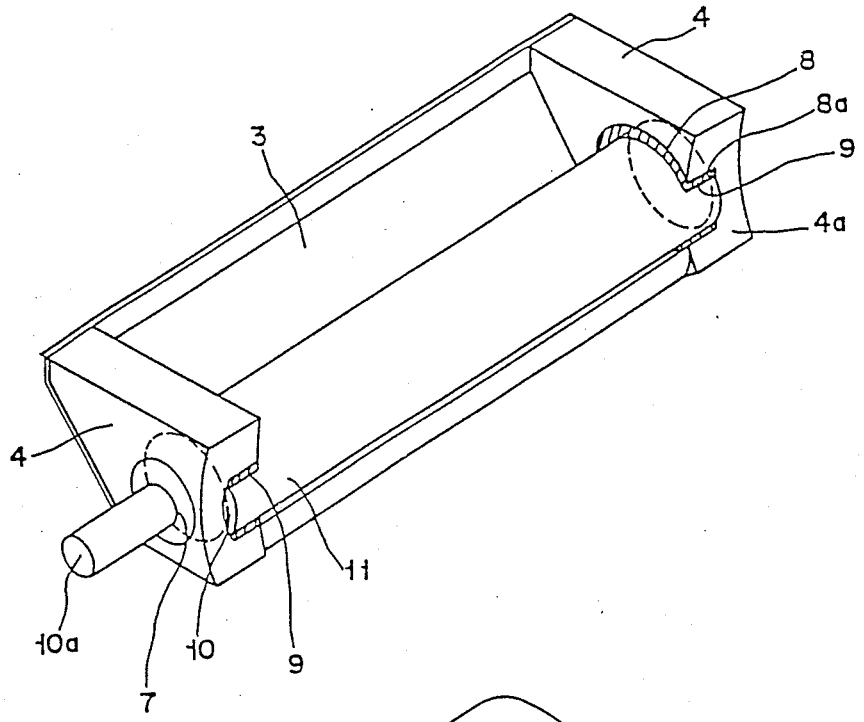
FIG. 2 is a perspective view of a developing roller incorporated into a developer tank in the developing device of FIG. 1.

As shown in FIG. 2, the developing roller 10 loosely mounting the filmy member 11 therearound is provided with a rotary shaft 10*a*, which is inserted into openings 7 defined in the side plates 4 to be rotatably supported thereby, with a driving source (not shown) being drivingly connected to the rotary shaft 10*a*. Both end portions of the developing roller 10 are located in concave portions 8 defined in respective side plates 4. The elastic guide pad 9 is interposed, in each concave portion, between the side plate 4 and each end portion of the filmy member 11 so that the filmy member 11 may be brought into close contact with the external surface of the developing roller 10. As the elastic guide pad 9 is used, for example, either of a material such as polyacetal, polyethylene, nylon, phenol resin, fluorine resin or the like, a member having a film of polyethylene, nylon, Teflon (trademark for tetra fluoroethylene fluorocarbon polymers used in trade and manufactured by Du Pont) or the like on its contact surface with the filmy member 11, or a foamed material having such film on its surface.

The concave portion 8 defined in each cover 4 is open on the side of the photoreceptor drum 100, i.e., on the front side 4*a* of the side cover 4, thus resulting in that there exists no guide pad 9 at such portion.

Accordingly, a portion of the filmy member 11 in contact, on its one side, with the guide pad 9 is brought into close contact, on its other side, with the external surface of the developing roller 10, and the other portion thereof located on the front side 4*a* of the side plate 4 is caused to protrude outwards so that a space 5 may be defined between the filmy member 11 and the developing roller 10. This is because an excessive peripheral portion of the filmy member 11 having the longer periphery than that of the developing roller 10 is collected on such open side of the concave portion 8. Consequently, the protruding portion of the filmy member 11 covering the space S is brought into contact, at its external surface, with the peripheral surface of the photoreceptor drum 100.

It is to be noted here that the guide pad 9, the developing roller 10 and the filmy member 11 are selected to satisfy a relationship of $\mu 1 > \mu 2$, where a dynamic coefficient of friction between the external surface of the developing roller 10 and the internal surface of the filmy member 11 is $\mu 1$, and that between the external surface of the filmy member 11 and the guide pad 9 is $\mu 2$. Such relationship has been obtained on the basis of three experimental results as will be explained in detail hereinafter.

Accordingly, when the developing roller 10 is caused to rotate in a direction as shown by an arrow (b), the filmy member 11 rotates together with the rotation of the developing roller 10 without any slip between the two and, the external surface of the filmy member 11 covering the space S is continuously kept in contact, through its suitable nip width (a peripheral length of a contact portion between the photoreceptor drum 100 and the filmy member 11), with the external surface of the photoreceptor drum 100 during the rotation of the two.

Figure 4:
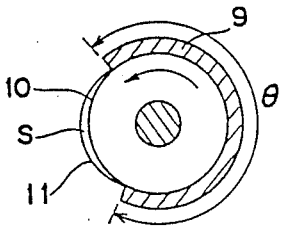
FIG. 4 is a cross-sectional view of the developing roller mounting thereon a guide member through the filmy member.

It is to be noted here that as shown in FIG. 4, a central angle $\theta$ of the filmy member 11 covered with the guide pad 9 is required to be made as large as possible within a range in which the former can contact, through its sufficient nip width, with the latter so that the filmy member 11 may steadily function without any excessive looseness or slack.

The blade 12 having, at its forward end, a flexible sheet, for example, of Teflon, nylon or the like is securely mounted on the rear side of the support member 6 provided immediately above the developing roller 10. The blade 12 resiliently presses the developing roller 10 through the filmy member 11 at an oblique upper portion on the rear side thereof. The blade 12 is of either of a springy metallic thin plate of SK-steel, stainless steel, phosphor bronze or the like, an elastic plate of silicone rubber, urethane rubber or the like, a resinous plate of fluorine resin, a nylon plate or the like. Furthermore, a compounded plate of such plates may be also used as the blade 12, on condition that it is distinct from the toner in electrostatic susceptibility.

A toner levelling pad 13 is mounted on a portion of the casing 3 of the developer tank 2 confronting the developing roller 10 and brought into indirect contact with the external surface thereof through the filmy member 11. The toner levelling pad 13 is of an elastic member formed, for example, of foamed urethane and covered with a silicone rubber sheet.

A toner storing compartment 15 is formed at the rear portion of the developer tank 2 and is internally provided with an agitator 14 disposed rotatably in a direction as shown by an arrow (c). The agitator 14 functions to agitate the toner To stored in the toner storing compartment 15 in a direction as shown by the arrow (c) for prevention of blocking thereof or the like.

It is to be noted that although non-magnetic toner is desirably employed as one-compartment toner in the developing device of this embodiment, magnetic toner may be used therein.

The operation of the developing device 1 having the above described construction will be explained hereinafter.

On condition that the developing roller 10 and the agitator 14 are caused to rotate by a driving source (not shown) respectively in directions as shown by the arrows (b) and (c), the toner To accommodated within the toner storing compartment 15 is forcibly moved in a direction shown by the arrow (c) under an effect of stirring by the agitator 14.

Meanwhile, the filmy member 11 is driven to rotate in a direction as shown by the arrow (b) under the influence of frictional force exerting between it and the developing roller 10, thus resulting in that the toner To in contact with the filmy member 11 is transported in a direction of rotation of the filmy member 11 by the action of electrostatic force. When the toner To is caught in a V-shaped taking-in portion 18 formed between the filmy member 11 and the forward portion of the blade 12 and reaches a pressure portion between the filmy member 11 and the blade 12, the toner To is spread uniformly in the form of a thin layer on the surface of the film member 11 and charged positively through the friction therewith.

When the toner To held on the filmy member 11 under the influence of the electrostatic force, reaches a developing region X confronting the photoreceptor drum 100 in compliance with the movement of the film member 11 following the developing roller 10, the toner To is caused to adhere to an electrostatic latent image formed on the surface of the photoreceptor drum 100 to form a toner image in accordance with a voltage difference between a surface voltage of the photoreceptor drum 100 and the bias voltage applied to the developing roller 10.

Since the filmy member 11 in contact with the photoreceptor drum 100 is never brought into contact with the developing roller due to the existence of the space S, the filmy member 11 softly and uniformly contact with the photoreceptor drum 100 through its suitable nip width so that the latent image formed on the photoreceptor drum 100 may be turned to the uniform toner image. In the case where a peripheral speed of the photoreceptor drum 100 is caused to differ from that of the filmy member 11, a fog can be effectively prevented in a non-image portion and the toner image once formed on the photoreceptor drum 100 can never be broken.

The toner To having passed the developing region X is successively transported, together with the filmy member 11, in a direction as shown by the arrow (b). When the toner To passes between the toner levelling pad 13 and the filmy member 11, an image pattern from which the toner To has already been consumed in the developing region X is erased so that the uniformity of the toner layer may be obtained.

Consequently, the thin layer of the charged toner is uniformly formed again on the surface of the filmy member 11 at the pressure portion of the blade 12 and, the aforementioned operation is repeated thereafter.

In the next place, the experiments 1 through 3 will be explained hereinafter, in which an investigation has been conducted with respect to influence upon the developing operation by a relationship between, a dynamic coefficient of friction $\mu 1$ between the developing roller 10 and the filmy member 11, and another dynamic coefficient of friction $\mu 2$ between the guide pad 9 and the external surface of the filmy member 11.

EXPERIMENT 1

(a) Experimental conditions:

(1) Filmy member 11
- Material: Nickel electroformed film
- Thickness: 50$\mu$
- Surface roughness: 3–6$\mu$ in 10-point average roughness of JIS (Japanese Industrial Standard) B 0601

(2) Developing roller 10
- Material: Aluminum roller (3) Guide pad 9
- Material: Polyacetal resin (4) Blade 12
- Material: Thin plate of SK-steel
- Thickness: 0.1 mm
- Force applied: 2.0 g/mm (5) Toner levelling pad 13
- Material of main body: Elastic member of foamed urethane
- Material of surface layer: Silicone rubber sheet (6) Dynamic coefficient of friction between the internal surface of the filmy member 11 and the surface of the developing roller 10: $\mu 1 = 0.1$–$0.2$ (7) Dynamic coefficient of the external surface of the filmy member 11 and the surface of the guide pad 9: $\mu 2 = 0.4$–$0.5$ (b) Result:

The developing could not be achieved, since the toner To could not be transported due to occurrence of a slip between the developing roller 10 and the filmy member 11.

EXPERIMENT 2

(a) Experimental conditions:
(1) Filmy member 11
Material: Nickel electroformed film
Thickness: 30–40μ
Surface roughness: 3–6μ in 10-point average roughness of JIS (Japanese Industrial Standard) B 0601
(2) Developing roller 10
Material: Neoprene-butadiene-copolymer rubber including carbon, with an electrically conductive treatment having been executed thereon
(3) Guide pad 9
Material: Polyacetal resin
(4) Blade 12
Material: Silicone rubber
Thickness: 2.0 mm
Force applied: 2.0 g/mm
(5) Toner levelling pad 13
Material of main body: Elastic member of foamed urethane
Material of surface layer: Silicone rubber sheet
(6) Dynamic coefficient of friction between the internal surface of the filmy member 11 and the surface of the developing roller 10: $\mu 1=0.6–0.75$
(7) Dynamic coefficient of the external surface of the filmy member 11 and the surface of the guide pad 9: $\mu 2=0.4–0.5$
(b) Result:
The developer could be steadily transported, since the filmy member 11 was driven to rotate together with the rotation of the developing roller 10 without any slip between the two.

EXPERIMENT 3

(a) Experimental conditions:
(1) Filmy member 11
Material: Polycarbonate resin
Thickness: 70–150μ
Surface roughness: 3–6μ in 10-point average roughness of JIS (Japanese Industrial Standard) B 0601
(2) Developing roller 10
Material of the surface layer: Silicone rubber including carbon, with an electrically conductive treatment having been executed thereon
(3) Guide pad 9
Material: Polyacetal resin
(4) Blade 12
Material: Thin plate of stainless steel
Thickness: 0.1 mm
Force applied: 2.0 g/mm
(5) Toner levelling pad 13
Material of main body: Elastic member of foamed urethane
Material of surface layer: Silicone rubber sheet
(6) Dynamic coefficient of friction between the internal surface of the film member 11 and the surface of the developing roller 10: $\mu 1=0.5–0.8$
(7) Dynamic coefficient of the external surface of the filmy member 11 and the surface of the guide pad 9: $\mu 2=0.2–0.4$
(b) Result:
As similar to the aforegoing Experiment 2, the developer could be steadily transported, since the filmy member 11 was driven to rotate together with the rotation of the developing roller 10 without any slip between the two.

Figure 5:
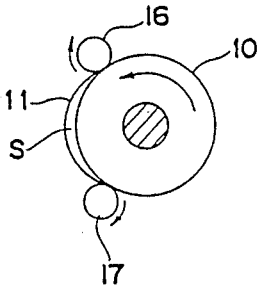
FIG. 5 is a cross-sectional view of the developing roller mounting thereon a couple of guide rollers through the filmy member.

It is to be noted here that the guide pad 9 in the above described embodiment may be replaced by a couple of guide rollers 16 and 17 rotatably disposed on the developing roller 10 through the filmy member 11 at the upper and lower portions thereof confronting the photoreceptor drum 100, as shown in FIG. 5. In such an arrangement, when the filmy member 11 is biased at the upper and lower portions of the space S against the developing roller 10 by the guide rollers 16 and 17, the space S can be formed uniformly in a direction of the central axis of the developing roller 10.

Figure 6:
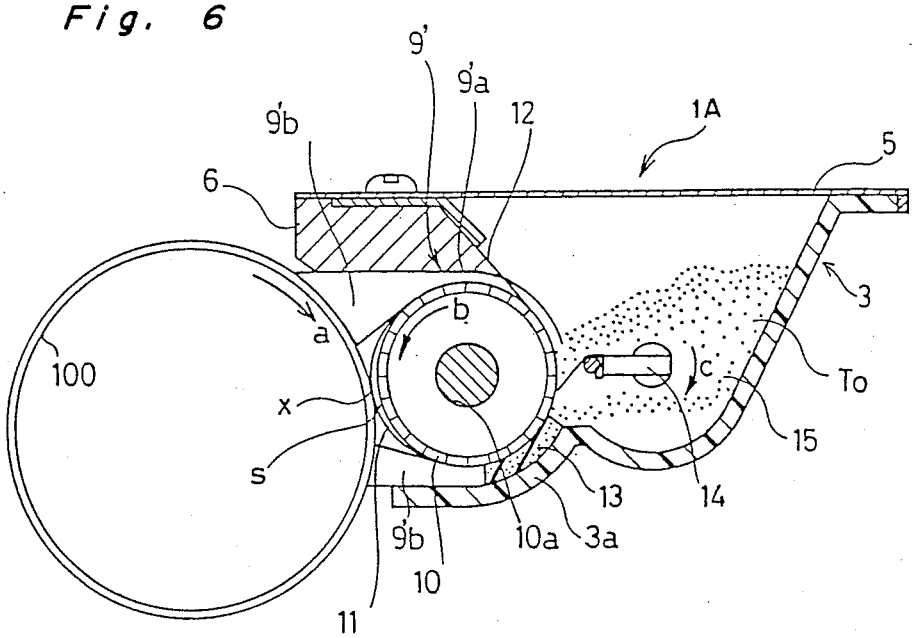
FIG. 6 is a cross-sectional view of a developing device according to a second embodiment of the present invention.

FIG. 6 shows a developing device according to a second embodiment of the present invention, which includes two guide pads 9' of a construction different from that of the first embodiment.

Figure 7:
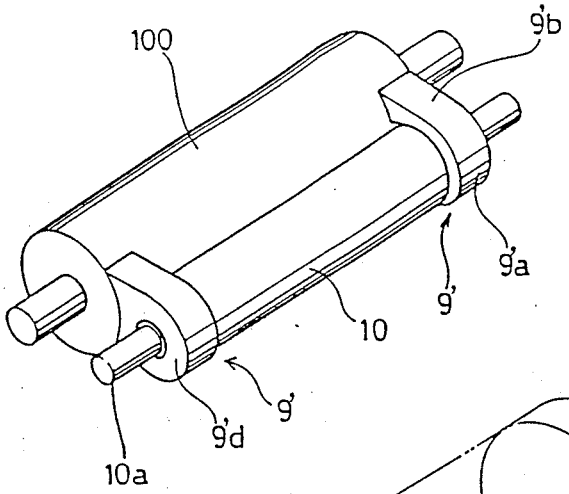
FIG. 7 is a perspective view of a developing roller mounting thereon a couple of guide members in the developing device of FIG. 6.
Figure 8:
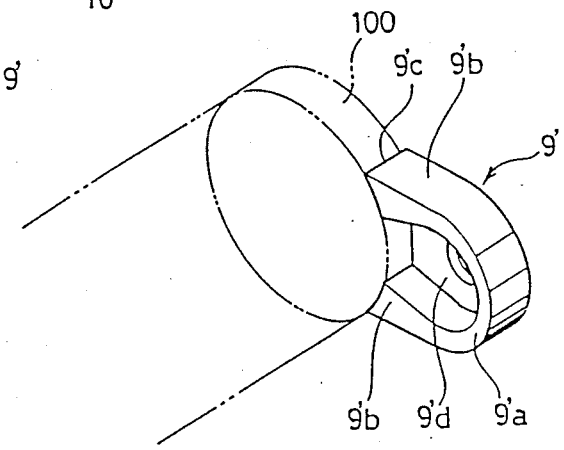
FIG. 8 is a perspective view of one guide member of FIG. 7.

As shown in FIG. 7, the guide pads 9' are disposed at opposite ends of a developing roller 10 loosely mounting thereon a filmy member 11, likewise in the first embodiment. Each guide pad 9' in this embodiment is, however, composed of a pressure portion 9'a for biasing the filmy member 11 against the developing roller 10, two contact portions 9'b to be brought into contact with the photoreceptor drum 100 and a side plate 9'd through which one support shaft 10a of the developing roller 10 extends, with the pressure portion 9'a, the contact portions 9'b and the side plate 9'b being integrally formed into a one-piece construction. As shown in FIG. 8, the internal surface of the pressure portion 9'a is formed circularly to coincide with a configuration of the external surface of the developing roller 10. Two contact portions 9'b extend from respective ends of the pressure portion 9'a and each of them defines a contact surface 9'c corresponding to a configuration of the peripheral surface of the photoreceptor drum 100.

Figure 9:
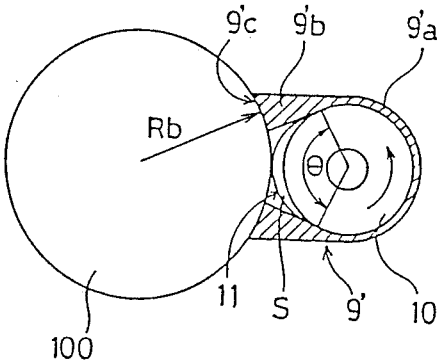
FIG. 9 is a schematic diagram showing a positional relationship among the guide member, the developing roller and a photoreceptor in the developing device of FIG. 6.

Accordingly, as shown in FIG. 9, since the pressure portion 9'a causes the filmy member 11 to closely contact with the periphery of the developing roller 10, the slack of the filmy member 11 is collected within an angular range $\theta$ in which the guide pad 9' is open on the side thereof confronting the developing roller 100 so that the space S may be constantly formed.

Furthermore, when the configuration of the contact surface 9'c is determined by a curvature radius 1/Rb of the external surface of the photoreceptor drum 100 to be completely coincident therewith, the positioning of the developing roller 10 with respect to the photoreceptor drum 100 is effectively conducted and a twist or deviation between the rotary shaft of the developing roller 10 and that of the photoreceptor drum 100 can be inevitably corrected, thus resulting in that it is made possible to steadily bring the external surface of the filmy member 11 covering the space S in close contact with the peripheral surface of the photoreceptor drum 100 under a predetermined contact pressure through its contact area (nip width).

Figure 10:
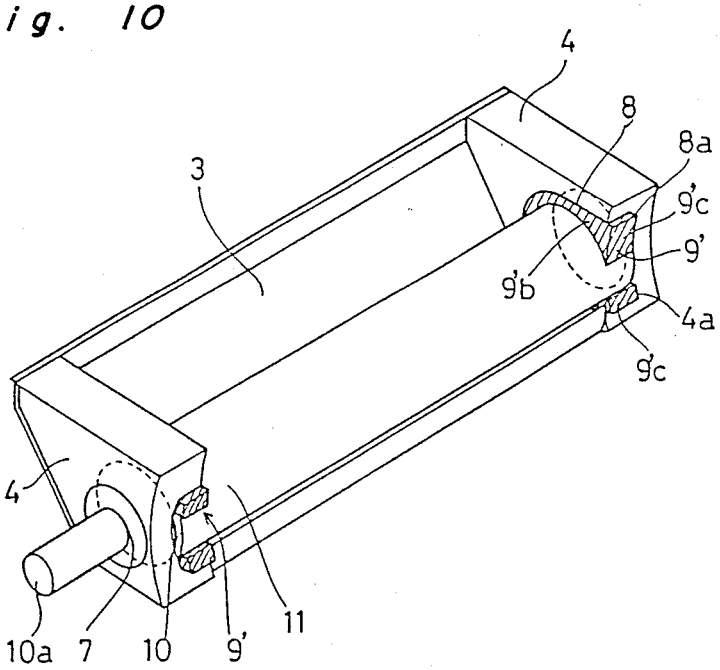
FIG. 10 is a perspective view of the developing roller incorporated into a developer tank in the developing device of FIG. 6.

FIG. 10 illustrates the developing roller 10 incorporated in the casing 3, with the guide pad 9' being interposed therebetween. The pressure portion 9'a of the guide pad 9' is mounted in the concave portion 8 so that the filmy member 11 is kept in close contact with the external surface of the developing roller 10. The contact surface 9'c of the contact portion 9'b is caused to protrude forwards from the front surface 4a of the side plate 4 to be brought into slide contact with the photoreceptor drum 100.

Figure 11:
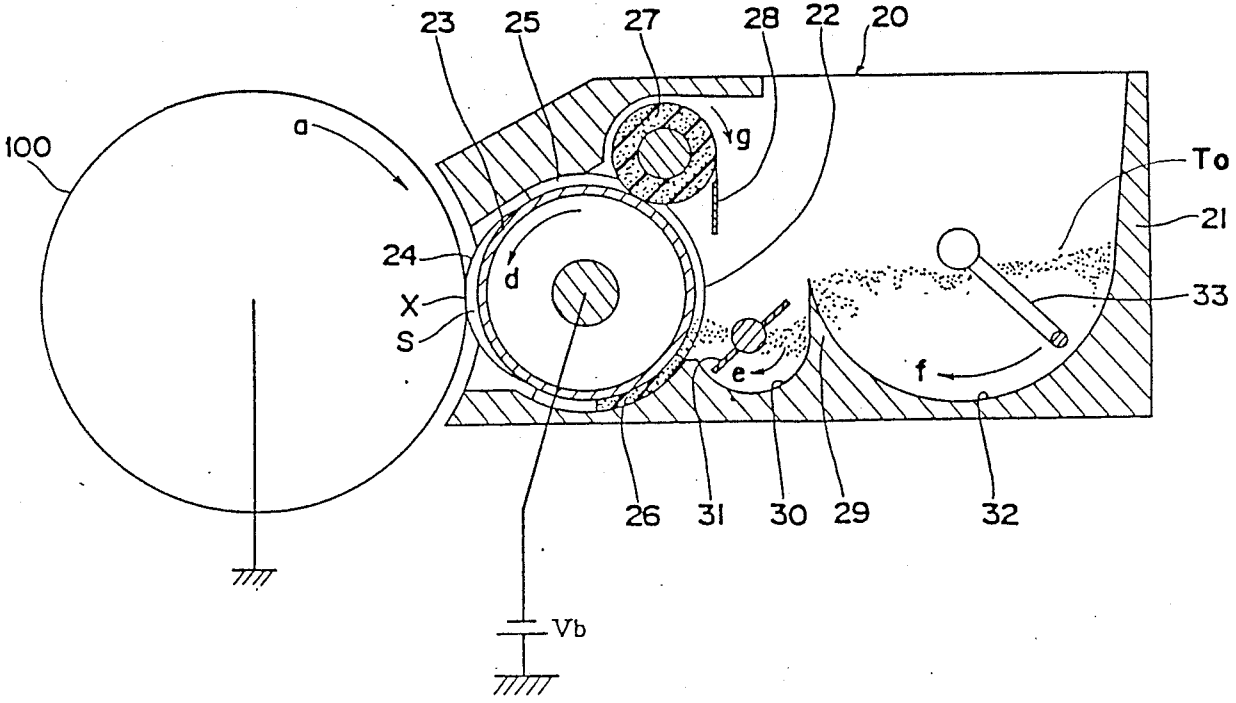
FIG. 11 is a cross-sectional view of a developing device according to a third embodiment of the present invention.

There is shown in FIG. 11, a developing device 20 according to a third embodiment of the present invention. The developing device 20 in this embodiment also employs therein one-component developer as in the first or second embodiment and is internally provided with a developing roller 23, a filmy member 24, two elastic guide pads 25 and a toner levelling pad 26, all of which are substantially similar, in construction and in arrangement, to those of the first embodiment.

A thin layer forming roller 27, for example, of foamed urethane is disposed rotatably in a direction as shown by an arrow (g) at an oblique upper portion on the rear side of the developing roller 23. The thin layer forming roller 27 is biased against the peripheral portion of the developing roller 23 through the filmy member 24. A blade 28 is disposed at a rear portion of the thin layer forming roller 27 and the forward end of the former is pressed against the surface of the latter. The developer tank 21 defines therein two adjacent agitation chambers 30 and 32 at the rear portion thereof on the rear side of the developing roller 23. The agitation chambers 30 and 32 respectively accommodate a toner supply blade 31 rotatable in a direction as shown by an arrow (e) and an agitator 33 rotatable in a direction as shown by an arrow (f).

In the developing device 20 having the above described construction, the toner To accommodated in the agitation chambers 30 and 32 is transported forwards, while agitated with the rotation of the toner supply blade 31 and the agitator 33.

Meanwhile, the filmy member 24 is driven to rotate in a direction as shown by an arrow (d) in accordance with the frictional contact with the developing roller 23 and, the toner To is held on the surface of the filmy member 24 by the electrostatic force through the frictional contact therewith so that the toner To may be transported in a direction as shown by the arrow (d). The toner To held on the surface of the filmy member 24 is transported towards a position confronting the thin layer forming roller 27 and, a thin layer of the charged toner is formed at the time when the toner To is brought into contact with the thin layer forming roller 27.

It is further to be noted that a peripheral speed of the thin layer forming roller 27 may be caused to be identical with or different from that of the developing roller 23. However, when the peripheral speed of the filmy member 24 differs from that of the thin layer forming roller 27, the thin layer of the toner To can be formed more uniformly.

It is to be noted here that the thin layer forming roller 27 may be caused to rotate in a direction contrary to the direction shown in FIG. 11.

The toner To remaining on the surface of the thin layer forming roller 27 after having passed the contact portion with the filmy member 24, is transported in a direction as shown by the arrow (g) through the rotation thereof and is, then, caused to drop into the agitation chamber 30 by being scraped by the forward end of the blade 28.

The thin layer of the toner To formed on the surface of the filmy member 24 in the above described manner, is transported in a direction as shown by the arrow (d), together with the rotation of the filmy member 24 following the developing roller 23. Thereafter, the thin layer of the toner To is brought into soft contact with the surface of the photoreceptor drum 100 at a developing region X so that a latent image may be caused to be visible.

The toner To having passed the developing region X is successively transported in a direction as shown by the arrow (d) together with the rotation of the filmy member 24. When the toner To passes between the toner levelling pad 26 and the filmy member 24, an image pattern from which the toner To has already been consumed in the developing region X is erased so that the toner layer may be unified.

Consequently, the uniform thin layer of the charged toner is formed again on the surface of the filmy member 24 at the pressure portion of the thin layer forming roller 27 and, the aforementioned operation is repeated thereafter.

Figure 12:
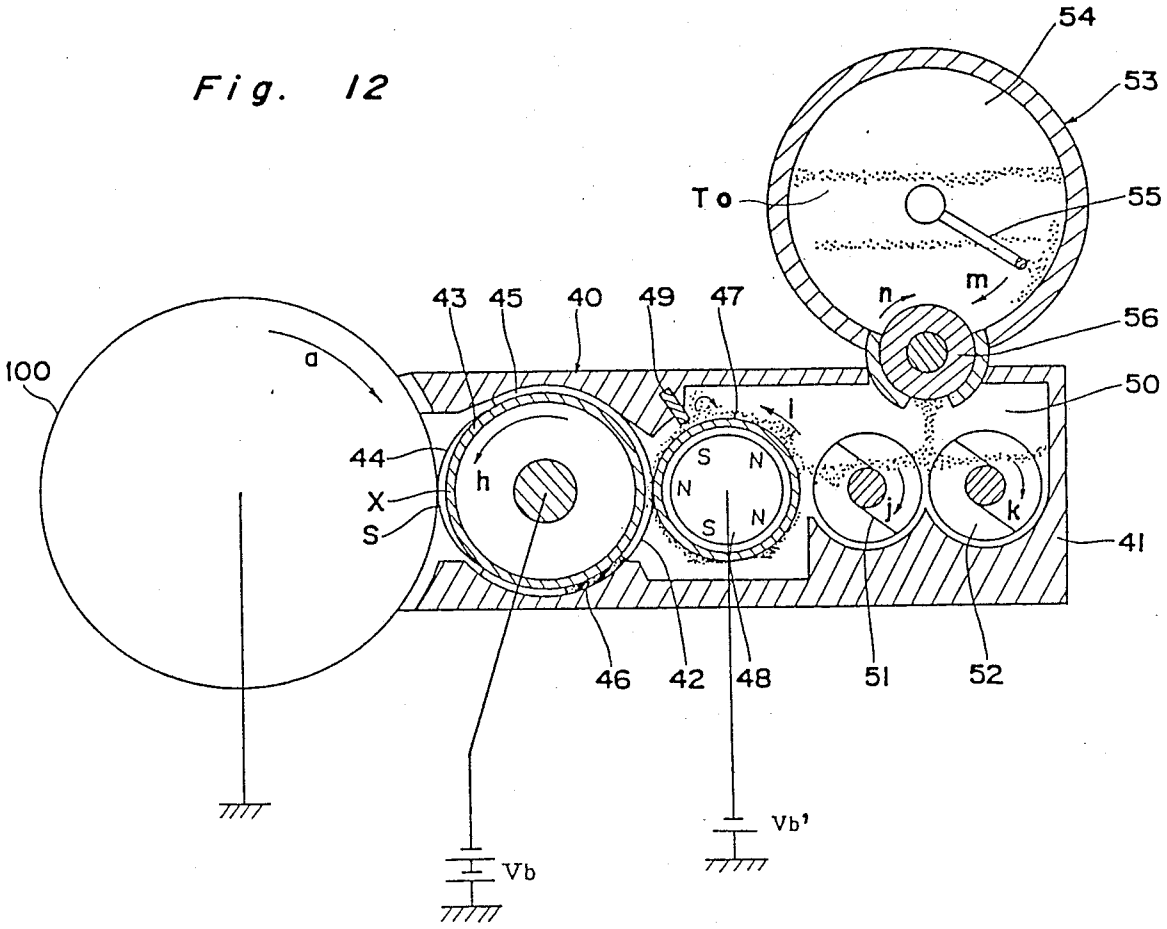
FIG. 12 is a cross-sectional view of a developing device according to a fourth embodiment of the present invention.

FIG. 12 illustrates a developing device 40 according to a fourth embodiment of the present invention.

The developing device 40 in this embodiment employs therein two-component developer including toner and carrier, and is, therefore, different from that of the first, second or third embodiment. However, a developing roller 43 disposed at a front portion of a developer tank 41, a filmy member 44, two elastic guide pads 45 and a toner levelling pad 46 in this embodiment are similar in construction to those in the aforegoing embodiments. In FIG. 12, a sleeve 47 is disposed rotatably in a direction as shown by an arrow (i) at a rear portion of the developing roller 43. A magnetic roller 48 is stationarily disposed inside the sleeve 47 and is internally provided with a plurality of magnets disposed along its peripheral portion, each extending in parallel relationship with its central axis. A brush bristle adjusting member 49 is securely mounted on the developer tank 41 above an oblique upper portion of the sleeve 47 and the forward end thereof confronts the sleeve 47 in spaced relation by defining therebetween a predetermined brush bristle adjusting gap.

Two transport fins 51 and 52 are disposed rotatably in directions as shown by arrows (j) and (k), respectively and juxtaposed with each other.

A toner hopper 53 accommodating the toner To is removably disposed at an upper portion of the developer tank 41 and internally provided with an agitating blade 55 disposed rotatably in a direction as shown by an arrow (m). A toner replenishing opening is defined at a lower portion of the toner hopper 53 and a replenishing roller 56 is accommodated therein so as to be rotatable in a direction as shown by an arrow (n) to replenish the toner To into the developer tank 41.

In the developing device 40 having the above described construction, the two-component developer including the toner To and the carrier is agitated into a mixed state in accordance with the rotation of the transport fins 51 and 52, thus resulting in that the toner To and the carrier are charged with opposite polarities through mutual frictional contact. In this event, a part of the developer is magnetically held on the surface of the sleeve 47 by being drawn thereto under the influence of magnetic force of the magnetic roller 48.

The developer held on the sleeve 47 is transported in a direction as shown by the arrow (i) in accordance with the rotation of the sleeve 47 and the brush bristle adjusting member 49 adjusts an amount of the developer to be transported.

The developer having passed a position confronting the brush bristle adjusting plate 49 is, then, transported to another position confronting the developing roller 43 in a state of magnetic brush, from which position the developer is supplied onto the surface of the filmy member 44 due to the presence of voltage difference between bias voltage Vb' applied to the sleeve 47 and another bias voltage Vb applied to the developing roller 43 so that a uniform thin layer of the toner To may be formed on the surface of the filmy member 44.

After having passed the aforementioned position of the sleeve 47 confronting the developing roller 43, the developer still adhering to the surface of the sleeve 47 is further transported in a direction as shown by the arrow (i). When the developer has come to a location opposed to the transport fin 51, it is separated from the surface of the sleeve 47 to be mingled with the developer being agitated by the transport fin 51.

The toner To supplied onto the surface of the filmy member 44 is transported in a direction as shown by the arrow (h), as in the above described embodiments, and brought into soft contact with the surface of the photoreceptor drum 100 so that the latent image may be caused to be visible. After the toner To has passed between the toner levelling pad 46 and the filmy member 44, new toner To is replenished onto the filmy member at a location thereof confronting the sleeve 47 so that an image pattern from which the toner To has already been consumed in the developing region X may be erased.

Upon repeated execution of the developing operation in the aforementioned manner, when an amount of the toner To accommodated within the developer tank 41 has reduced, new toner To is replenished from the toner hopper 53 upon rotation of the replenishing roller 56.

It is to be noted here that in this embodiment, although only the sleeve 47 is arranged rotatably and the magnetic roller 48 is arranged stationarily, the magnetic roller 48 may be replaced by a rotatable one.

It is further to be noted that the developer may be transported only through the rotation of the magnetic roller 48, with the sleeve 47 being disposed stationarily.

In short, any arrangement capable of transporting the developer in a direction as shown by the arrow (i) is applicable in the developing device 40.

If an alternating electric field is further applied between the developing roller 43 and the sleeve 47 in addition to the aforegoing bias voltages, the supply or collection of the toner To can be executed more effectively.

Moreover, if at least one groove is spirally formed throughout the peripheral surface of the filmy member, paper dust, foreign particles or the like clogged between the thin layer forming means and the filmy member can be automatically readily eliminated, thus resulting in that the image can be improved in quality without any occurrence of unevenness of the thin layer of the charged toner.

As clearly described so far, in the developing device according to the present invention, the filmy member having a peripheral length longer than that of the developing roller is loosely mounted around the developing roller and, a space is formed between the filmy member and the developing roller at a location confronting the electrostatic latent image support member. By such an arrangement, a part of the filmy member covering the space is brought into soft contact with the surface of the electrostatic latent image support member so that the toner held on the surface of the film member may be supplied onto the electrostatic latent image formed on the surface of the electrostatic latent image support member.

Accordingly, the surface of the electrostatic latent image support member is prevented from being damaged. Furthermore, even when a gap is unevenly formed between the developing roller and the electrostatic latent image support member due to respective warp, twist or the like, such unevenness is absorbed by the protruding portion of the filmy member covering the space, thus resulting in that the gap between the developing roller and the electrostatic latent image support member can be readily adjusted. Moreover, since the toner layer formed on the filmy member is kept in soft contact with the electrostatic latent image support member through its sufficient nip width, the toner image formed on the electrostatic latent image support member never be broken, even if a peripheral speed thereof differs from that of the developing roller. Consequently, picture quality can be prevented from lowering and, a printed image having steady uniform density can be obtained.

In addition, in a toner supply portion where the toner is spread on the surface of the filmy member, since the filmy member is kept in close contact with the developing roller, a thin layer forming member can be brought into steady contact with the filmy member, even when a blade is used as the thin layer forming member. Accordingly, in the toner supply portion, since the blade can be pressed against the filmy member under sufficient pressure, electrostatic potential of the charged toner can be raised up to a desirable value, thereby enabling the thin layer of the toner to be formed uniformly.

On the other hand, in a developing region, since the filmy member is kept in contact with the electrostatic latent image support member through its sufficient nip width so that the toner may be uniformly supplied onto the electrostatic latent image, the printed image having steady uniform density can be obtained.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A developing device disposed adjacently to a rotatably arranged electrostatic latent image support member, which comprises:

a rotatably disposed developing roller confronting said electrostatic latent image support member;

a cylindrically formed flexible outer sleeve member having a peripheral length longer than that of said developing roller and loosely mounted therearound;

first means for biasing said outer sleeve member against said developing roller to form a slack of said outer sleeve member at a location confronting said electrostatic latent image support member; and second means for forming a toner layer on external surface of said outer sleeve member.

2. A developing device as claimed in claim 1, wherein said first means has an internal peripheral surface coincident with an external peripheral surface of said developing roller to bias said outer sleeve member against said developing roller through respective peripheral surfaces.

3. A developing device disposed adjacently to a rotatably arranged electrostatic latent image support member, which comprises:

a rotatably disposed developing roller confronting said electrostatic latent image support member;

a cylindrically formed flexible outer sleeve member having a peripheral length longer than that of said developing roller and loosely mounted therearound;

first means for bringing said outer sleeve member partly into contact with said developing roller to define a space between said developing roller and said outer sleeve member at a location confronting said electrostatic latent image support member so that an external peripheral surface of the outer sleeve member covering said space may be brought into contact with said electrostatic latent image support member; and second means for forming a thin layer of charged toner on external surface of said outer sleeve member through contact therewith, said outer sleeve member being caused to rotate together with rotation of said developing roller.

4. A developing device as claimed in claim 3, wherein said first means comprises a contact portion covering a part of the external surface of said developing roller through said outer sleeve member and a protruding portion protruding towards said electrostatic latent image support member by a predetermined length, a contact length between said outer sleeve member and said electrostatic latent image support member being maintained upon contact of said protruding portion with said electrostatic latent image support member.

5. A developing device as claimed in claim 4, wherein said protruding portion has, at its forward end, a surface coincident with the peripheral surface of said electrostatic latent image support member.

6. A developing device as claimed in claim 3, wherein said first means has a guide surface coincident with the peripheral surface of said developing roller.

7. A developing device as claimed in claim 3, wherein said second means is a blade extending in a direction of the central axis of said developing roller.

8. A developing device as claimed in claim 3, wherein said second means is a roller rotatably located in juxtaposition with said developing roller, with said outer sleeve member being interposed therebetween.

9. A developing device as claimed in claim 3, wherein said outer sleeve member is made of a resinous sheet.

10. A developing device as claimed in claim 3, wherein said outer sleeve member is made of a metallic thin film.

11. A developing device as claimed in claim 3, wherein said outer sleeve member has a groove spirally formed throughout the peripheral surface thereof.

12. A developing device as claimed in claim 6, wherein said guide surface of the first means, said developing roller and said outer sleeve member are selected to satisfy a relationship of $\mu 1 > \mu 2$, where a dynamic coefficient of friction between the external surface of said developing roller and the internal surface of said outer sleeve member is $\mu 1$, and that between the external surface of said outer sleeve member and said guide surface of the first means is $\mu 2$.

* * * * *